United States Patent [19]

De Simone

[11] 4,018,719

[45] Apr. 19, 1977

[54] SYNTHETIC MUSK PERFUME COMPOUND 1,1,2,3,3,5-HEXAMETHYLINDAN-6-NITRILE

[75] Inventor: Robert S. De Simone, Middletown, N.Y.

[73] Assignee: Polak's Frutal Works, Inc., Middletown, N.Y.

[22] Filed: Apr. 20, 1976

[21] Appl. No.: 678,782

[52] U.S. Cl. ..... 252/522; 260/465 R

[51] Int. Cl.[2] ..... C11B 9/00

[58] Field of Search ..... 260/465 R; 252/522

[56] References Cited

UNITED STATES PATENTS

| | | | |
|---|---|---|---|
| 2,507,473 | 5/1950 | Koelsch | 260/465 R |
| 2,759,022 | 8/1956 | Fuchs | 252/522 |
| 2,889,367 | 6/1959 | Beets et al. | 252/522 |
| 2,897,237 | 7/1959 | Carpenter et al. | 252/522 |
| 3,644,540 | 2/1972 | Wood et al. | 252/522 |
| 3,910,853 | 10/1975 | Kulka | 252/522 |
| 3,920,585 | 11/1975 | Klein | 252/522 |

OTHER PUBLICATIONS

G. B. Pickering, Manufacturing Chemist, June, 1956, pp. 227–232.

M. G. J. Beets et al., Rec. Tran. Chim. 77, pp. 854–871, 1958.

M. G. J. Beets et al., Rec. Tran. Chim. 78, pp. 570–585, 1959.

*Primary Examiner*—Veronica O'Keefe

*Attorney, Agent, or Firm*—William S. Alexander

[57] ABSTRACT

The new compound 1,1,2,3,3,5-hexamethylindan-6-nitrile is disclosed. The compound exhibits a very strong musk odor which is greater than its commercially available ketone counterpart from which it is prepared. Its odor intensity is also greater than other known ketone musks.

3 Claims, 6 Drawing Figures

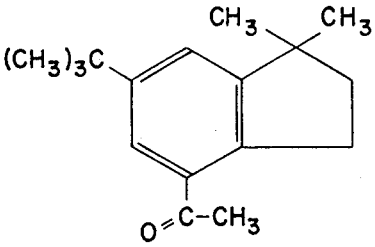
I
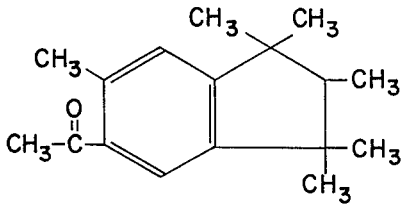
II
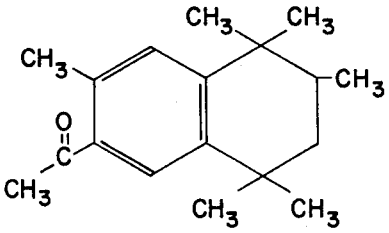
III
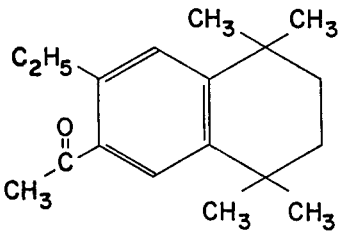
IV
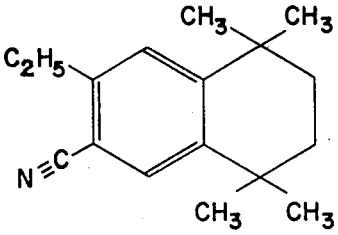
V
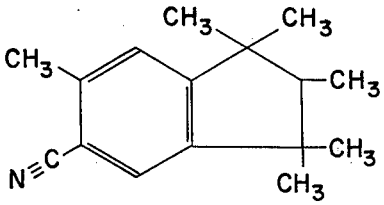
VI

SYNTHETIC MUSK PERFUME COMPOUND 1,1,2,3,3,5-HEXAMETHYLINDAN-6-NITRILE

This invention relates to a chemical compound which is useful in the perfumery art as a replacement for natural musk.

Musk odors are much in demand for perfumery uses in, e.g., perfumes, colognes, cosmetics, soaps and other household products. However, natural musk, which is obtained from the Asian Musk Deer, is extremely expensive due to its scarcity. For this reason, perfume chemists have expended considerable effort in the search for synthetic products in which the natural musk odor is duplicated or closely simulated. In addition to the need for fragrance materials having a natural musk odor, and in accordance with effects sought in modern perfumes, the search continues for synthetic musk equivalents having greater power, diffusion and stability along with novel fragrance attributes to expand the perfumer's palette.

A considerable number of synthetic musks have been found and commercially exploited. Structural formulas for some of the more inportant of these are shown in the drawing. Among these are included a series of keto-indans such as 3,3-dimethyl-5-t-butyl-7-acetoindan (I), known commercially as Celestolide (IFF Co.), and 1,1,2,3,3,5-hexamethyl-6-aceto-indan (II), known commercially as Phantolid (Polak's Frutal Works, Inc.). The ketone musk generally regarded as the best in the sense that it has the best odor intensity, however, is a tetralin musk product known as Tonalid (Polak's Frutal Works, Inc.), 1,1,3,4,4,6-hexamethyl-7-aceto-1,2,3,4-tetrahydronaphthalene (III). A related tetralin musk, known as Musk 36A (Universal Oil Products Co.), 1,1,4,4-tetramethyl-6-ethyl-7-aceto-1,2,3,4-tetrahydronaphthalene (IV), is also quite good. More recently, U.S. Pat. No. 3,910,853 has taught that nitriles corresponding to the product identified above as Musk 36A, i.e., 1,1,4,4-tetramethyl-6-ethyl-1,2,3,4-tetrahydronaphthalene-7-nitrile (V), is a good natural musk substitute.

Now it has been found that the product 1,1,2,3,3,5-hexamethylindan-6-nitrile (Compound (VII)) is also a very good natural musk substitute and is useful as a perfumery additive in most applications where the very expensive natural musk has heretofore been employed. The invention compound has been found to possess a natural, clean, civet or animal character in addition to an earthy mustiness desirable for modern perfumery effects. It has been seen as sweeter, stronger, more natural in aroma, and as having more diffusion than the commercial musk closest in odor character and strength, namely, Compound III. In addition to these qualities, the 1,1,2,3,3,5-hexamethylindan-6-nitrile has been found not to discolor when utilized as a perfume component in combination with other aroma chemicals in perfumed bases, e.g., for cosmetics, soaps, or household products or in alcohol solutions such as perfumes or colognes. The compound corresponds in chemical structure to the Keto-indan shown above and identified as Phantolid (Compound II), but it is many times stronger in terms of odor intensity than that compound. Moreover, the particular compound of this invention has been found to be several times stronger in musk aroma than any of the presently available commercial synthetic musks, as well as the aforementioned nitrile of U.S. Pat. No. 3,910,853 (Compound V).

The odor characteristics of the compound of this invention are unusual in comparison with those of nitriles corresponding in structure to other popular ketone musks. For example, the nitrile corresponding to 3,3-dimenthyl-5-butyl-7-acetoindan (Compound I above) has no musk or any other perfumery useful odor at all. The nitrile corresponding to 1,1,4,4-tetramethyl-6-ethyl-7-aceto-1,2,3,4-tetrahydronaphthalene (Compound III above) is weaker in odor intensity than the ketone. The compound of this invention has more odor strength and diffusion than any of the ketones (Compounds I through IV). The musk odor of Compound VI is much stronger than any of the nitriles corresponding to Compounds I, III and IV. This is quite unexpected since this is a reversal in the order of strength in the aceto series, i.e., Compound II, the ketone corresponding to the compound of the invention, is normally considered the weakest of the commercial ketone musks in the series including products I, III and IV.

The odor intensity of the 1,1,2,3,3,5-hexamethylindan-6-nitrile of this invention is such that the compound must be reduced in concentration by several fold in relation to the amount of other musks which would normally be used in similar applications. This is a distinct economic advantage, of course, inasmuch as a concentration of less than 1% can be employed to yeild odor effects comparable to those yielded by competitively priced products at 4 and 5% concentration.

The 1,1,2,3,3,5-hexamethylindan-6-nitrile is readily prepared from known commercially available starting materials. In a currently utilized synthesis, 1,1,2,3,3,5-hexamethyl-6-acetoindan is first converted to the 6-carboxylate by reaction with sodium hypochlorite:

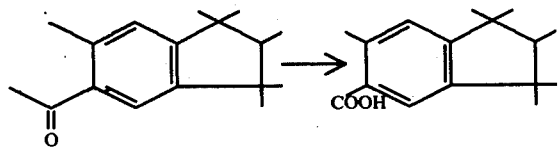

The resulting 1,1,2,3,3,5-hexamethylindan-6-carboxylate is converted to the 6-acid chloride by reaction with thionyl chloride in tetrahydrofuran at 60° to 66° C. for about 4.5 hours:

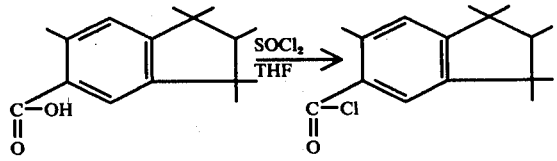

The 1,1,2,3,3,5-hexamethylindan-6-acid chloride produced in the above sequence is in succession treated with aqueous ammonium hydroxide solution at essentially ambient temperature to give the corresponding amide and next, again, reacted with thionyl chloride to effect dehydration to the desired compound, 1,1,2,3,3,5-hexamethylindan-6-nitrile.

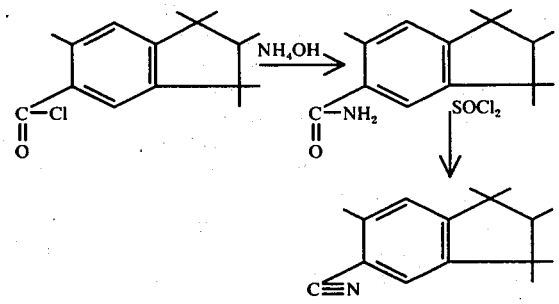

EXAMPLE 1

Preparation of 1,1,2,3,3,5-Hexamethylindan-6-Nitrile

Step I: 1,1,3,3,3,5-Hexamethylindan-6-Carboxylate

One hundred grams of 1,1,2,3,3,5-hexamethyl-6-acetyl indan was dissolved in 120 g. of t-butyl alcohol and this solution added to 2100 g. of commercial 5.75% sodium hypochlorite solution in a three-liter flask equipped with mechanical stirrer, thermometer, heating mantle and condenser. The resulting two-phase mixture was heated to reflux with stirring for 1 ¾ hours at 88° to 93° C. to give a clear, water-white solution. After cooling, 50 g. of sodium bisulfite was stirred in and a small amount of precipitate present was dissolved by the addition of caustic. The resulting solution was washed four times with ether, then vacuum stripped to remove traces of solvent. The carboxylic acid product was precipitated by the addition of sufficient concentrated HC1 to reduce the pH to about 1. The resulting white precipitate was recovered by filtration and the filter cake was air dried to constant weight, yielding 93.1 g. of product. An infrared spectrum of the product (mineral oil mull) showed a strong, broad band between 2100 and and 2950 $cm^{-1}$ having a maximum at approximately 2550 $cm^{-1}$ (acid OH stretch); an intense, ill-defined doublet at approximately 1675 $cm^{-1}$ and 1690 $cm^{-1}$ (aromatic carboxylic acid carbonyl stretch); weak bands at 1610 $cm^{-1}$ and 1570 $cm^{-1}$ (arqmatic ring skeletal in-plane vibrations); and intense band at 1274 $cm^{-1}$ (thought to be derived from coupled C—O and —H, in-plane deformation modes in carboxylic acids); a medium band at 1240 $cm^{-1}$; and a broad, medium-strength band having a maximum centered at 940 $cm^{-1}$ (carboxylic acid OH out of plane deformation).

Step II: 1,1,2,3,3,5-Hexamethylindan Acid Chloride

Into a 500 ml. flask equipped with mechanical stirrer, condenser, thermometer, addition funnel, cooling bath, and static nitrogen head was added a solution of 25 g. of the carboxylic acid product from Step I dissolved in 150 ml. of tetrahydrofuran. This solution was cooled to 60° C. and 14.5 ml. of thionyl chloride was added over 15 minutes at a temperature between 6° and 15° C. The cooling bath was removed, and the mixture was heated to reflux for a total of 4.5 hours at 60° to 66° C. The solution was cooled and solvent and excess thionyl chloride were removed by rotary evaporation at 10 mm., 50° C. for one-half hour. Inspection of the infrared spectrum (mineral oil mull) of the crude product showed the vitrual absence of the carboxylic acid OH stretch bands at 2550 $cm^{-1}$ and the carboxylic acid carbonyl stretch bands at 1675 $cm^{-1}$ and 1690 $cm^{-1}$ noted with the starting material. Newly present bands corresponding to the aryl acid chloride were found at about 1772 $cm^{-1}$ (medium intensity) and about 1730 $cm^{-1}$ (weak) while new medium intensity fingerprint bands were observed at 824 $cm^{-1}$, 783 $cm^{-1}$, and 708 $cm^{-1}$.

Step III: 1,1,2,3,3,5-Hexamethylindan-6-Carboxamide

The crude acid chloride from Step II was dissolved in 150 ml. of anhydrous tetrahydrofuran in a 500 ml. flask equipped with a thermometer, mechanical stirrer, and ice bath. A solution of concentrated ammonium hydroxide (27.6 ml., 30% $NH_3$) was added gradually over a 10-minute period at a temperature between 2° and 17° C. Stirring was continued for an additional hour at 10° to 23° C., at which point infrared spectroscopy on a sample showed the absence of the 1772 $cm^{-1}$ band of the acid chloride starting material. The reaction mixture was then washed three times with 100 ml. portions of 5% sodium hydroxide and the organic phase was vacuum evaporated to dryness. The amide product showed infrared bands (mineral oil mull) at between 3550 $cm^{-1}$ and 3050 $cm^{-1}$, medium sharp, characteristic of free and bonded NH stretch of amides; a strong band at 1665 $cm^{-1}$ characteristic of any aryl amide carbonyl stretch frequency, with medium to weak bands at 1565 $cm^{-1}$ and 1610 $cm^{-1}$.

Step IV: 1,1,2,3,3,5-Hexamethylindan-6-Nitrile

The crude product from Step III was dissolved in 250 ml. of benzene in a 50-ml. flask equipped with mechanical stirrer, cooling bath, thermometer, addition funnel, condenser, and static nitrogen head. Thionyl chloride (72 ml.) was added gradually with cooling over six mimutes at 24° to 30° C. The mixture was then heated to reflux for about 4 hours, and after cooling, 150 ml. of 5% sodium hydroxide solution was added at between 32° and 50° C., with cooling, over 16 minutes. The entire contents of the reaction flask were transferred to a separatory funnel and washed twice with 500 ml. of 5% sodium hydroxide solution. The washings were extracted in succession with 50 ml. of benzene. The organic phases were combined and flash evaporated on a rotary evaporator for one hour at 50° C. 10 mm. Hg to yiedl 30.6 g. of crude nitrile. The infrared spectrum (mineral oil mull) showed a medium intensity nitrile band at 2400 $cm^{-1}$. The crude nitrile was taken up in 100 ml. of benzene and run onto a 1 ⅛ inch by 35 inch chromatography column (wet-packed with 400 g. of MCB grade 923 silica gel using benzene as packing solvent). Pure nitrile was collected after 525 ml. of benzene were eluted from the column. A 5 g. portion of the chromatographed nitrile was recrystallized from hexane. The recrystallized nitrile was dissolved in 30 ml. of methanol, 2 g. of Draco K-9 activated carbon added, and the slurry filtered. After repeating the carbon treatment, the product was again recrystallized from hexane. The recrystallized product melted at 70.2° to 72.8° C. NMR spectrum ($CDCl_3$ with TMS reference):

Doublet centered at about 1.01δ (3 protons) for the 2-methyl, the higher ppm band of the doublet being submergered under a peak ascribed to either of a pair of geminal dimethyls at carbons 1 or 3 .

Singlet at 1.07δ (6 protons) for geminal dimethyls at either carbon 1 or 3 .

Singlet at 1.27δ (6 protons) for geminal dimethyls at either the 1 or 3 indane carbons.

Multiplet centered at about 1.88δ approximating a quartet (1 proton) for the two carbon methine.

Singlet at 2.53δ (3 protons) for the aromatic methyl.

Singlets at 7.11δ and 8.4δ (1 proton) each for the aromatic hydrogens at carbons 4 and 7.

EXAMPLE 2

A

The odor strength of the compound of Example 1 was compared to that of nitriles based on the compounds identified above as I, III and IV. A 5% ethyl alcohol solution of each was prepared and a perfumer's blotter was dipped into each a distance of about one inch. Odor comparisons were made by an experienced perfumer after the alcohol had evaporated completely. From this test it was determined that the nitrile based on Compound I had no musk odor. The other three all had musk odors but the compound of the invention was stronger at this level and had a mustier, earthier odor than the others.

B

The compound of the invention was then compared for odor intensity with its corresponding keto-indan counterpart (II). It was found via the blotter test that a 0.25% solution of the compound of the invention gives a stronger odor impression and a 0.125% solution a weaker impression than a 5% solution of its corresponding keto-indan (II). As dilution was increased, the musty-earthy odor became less pronounced and the musk character became more dominant. Based on this comparison, the odor intensity of this invention compound is shown to be between 20 and 40 times greater than its keto-indan counterpart.

Similar comparision was made of the compound of this invention with Compound III, heretofore regarded as the strongest of the commercially available synthetic musks. A 0.25% solution of the invention compound was equivalent in odor impression to a 5% solution of Compound III indicating about a 20 times greater odor intensity in the next compound when unassociated with other perfume oils.

EXAMPLE 3

A musk perfume was prepared by mixing the following ingredients:

hz,1/32

| | |
|---|---|
| 1,1,2,3,3,5-hexamethylindan-6-nitrile | 20 parts |
| Ethylene brassylate | 200 parts |
| Cyclopenta(g)-2-benzopyran-1,3,4,6,7,8-hexahydro-4,6,6,7,8,8-hexamethyl | 600 parts |
| Diethyl phthalate | 150 parts |

EXAMPLE 4

A floral bouquet perfume was prepared by mixing the following ingredients:

| | |
|---|---|
| 1,1,2,3,3,5-Hexamethylindan-6-nitrile | 10 parts |
| Jasmine absolute pure | 100 parts |
| Rose absolute maroc | 30 parts |
| Neroli oil | 15 parts |
| Orange flowers absolute | 5 parts |
| Bergamot oil | 90 parts |
| Lemon oil | 50 parts |
| Jasmine 231 (Firmenich & Co.) | 200 parts |

The novel odorant of this invention can be employed neat or in combination with other fragrance chemicals. They are useful in perfumes, colognes, cosmetics, soaps or other household products.

What I claim and desire to protect by Letters Patent is:

1. The compound 1,1,2,3,3,5-hexamethylindan-6-nitrile.

2. A perfume composition comprising an odor-modifying amount of the compound 1,1,2,3,3,5-hexamethylindan-6-nitrile.

3. A perfume composition comprising a mixture of perfuming ingredients and an odor-modifying amount of 1,1,2,3,3,5-hexamethylindan-6-nitrile.

* * * * *